United States Patent [19]

Brown

[11] 4,160,138

[45] Jul. 3, 1979

[54] SWITCH WITH INDEXING DETENT BLOCK

[75] Inventor: Harry W. Brown, Big Bend, Wis.

[73] Assignee: Cutler-Hammer, Inc., Milwaukee, Wis.

[21] Appl. No.: 829,808

[22] Filed: Sep. 1, 1977

[51] Int. Cl.[2] ..... H01H 21/04

[52] U.S. Cl. ..... 200/67A; 200/68; 200/153 LA

[58] Field of Search ..... 200/67 A, 67 G, 68, 200/153 G, 153 LA

[56] References Cited

U.S. PATENT DOCUMENTS

| | | | |
|---|---|---|---|
| 2,469,337 | 5/1949 | Kohl | 200/67 G |
| 2,723,571 | 11/1955 | Koenig | 74/528 |
| 2,757,252 | 7/1956 | Sparr et al. | 200/67 G |
| 2,908,777 | 10/1959 | Brown | 200/11 |
| 3,008,024 | 11/1961 | Roeser | 200/67 G |
| 3,327,078 | 6/1967 | Sorenson | 200/67 A |
| 3,641,291 | 2/1972 | Carling | 200/67 G |

FOREIGN PATENT DOCUMENTS

| | | | |
|---|---|---|---|
| 1193072 | 5/1970 | United Kingdom | 200/68 |

*Primary Examiner*—Herbert F. Ross

*Attorney, Agent, or Firm*—Hugh R. Rather; William A. Autio; Michael E. Taken

[57] ABSTRACT

A small toggle lever switch with positive position feel is disclosed. A toggle lever is pivotally mounted to a housing and has a shaft extending thereinto. Upper and lower plungers are slidably disposed on the shaft and are biased apart by a compression spring encircling the shaft. The lower plunger is biased downwardly into engagement with a teeter-totter type contactor for actuation thereof. The upper plunger is biased upwardly into engagement with a stationary block having a clearance aperture through which the shaft extends. The block has grooved detents which variously receive a complemental apex of the upper plunger to afford indexing as the toggle lever is pivoted.

14 Claims, 5 Drawing Figures

SWITCH WITH INDEXING DETENT BLOCK

BACKGROUND OF THE INVENTION

Indexing mechanisms for electric switches are known in the art. While these prior mechanisms have been useful for their intended purposes, the present invention relates to improvements thereover.

SUMMARY OF THE INVENTION

An object of the present invention is to provide improved indexing means for electric switches whereby to afford a positive position feel.

Another object is to provide indexing means equally adaptable for a two position switch, three position switch, etc.

Another object is to provide a switch wherein a single biasing means provides both contact pressure and positioning feel.

Another object is to provide an indexing mechanism for teeter-totter type contactors which additionally provides the following advantages over prior teeter-totter structures; contact pressure is increased at the most critical time of contactor motion, during the instant of contact make;

camming surfaces of an index block provide positive positioning independent of contactor shape;

positioning is improved with reduced possibility of hang-up between positions; and a teeter-totter surface has a constant radius about the pivot point of the toggle lever whereby the track for a spring loaded plunger on the toggle lever is of uniform curvature to thus minimize any effect the teeter-totter surface may have on toggle lever position.

Another object is to provide a miniature switch of the aforementioned character.

Other objects and advantages will hereinafter appear.

DESCRIPTION OF THE PREFERRED EMBODIMENT

Figure 1:
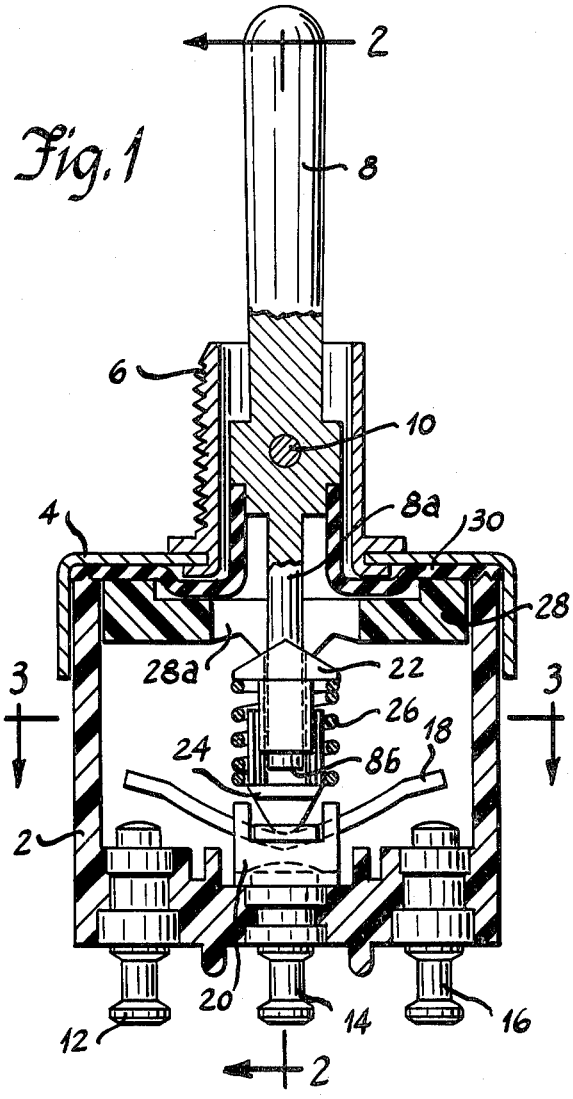
FIG. 1 is a cross-sectional view of a switch constructed in accordance with the invention, taken along line 1—1 of FIG. 2.

There is shown in the drawings a toggle lever switch employing a teeter-totter type contacting arrangement similar to that shown in H. W. Brown U.S. Pat. No. 3,350,521, issued Oct. 31, 1967, assigned to the assignee of the present invention, and hereby incorporated herein by reference.

An open topped insulating base 2 is closed by a cover 4 having a bushing 6 mounted thereto. A toggle lever 8 is pivotally mounted in the bushing by pivot pin 10 journaled through a central portion of the toggle lever and extending between opposed side walls of the bushing.

Figures 4, 5:
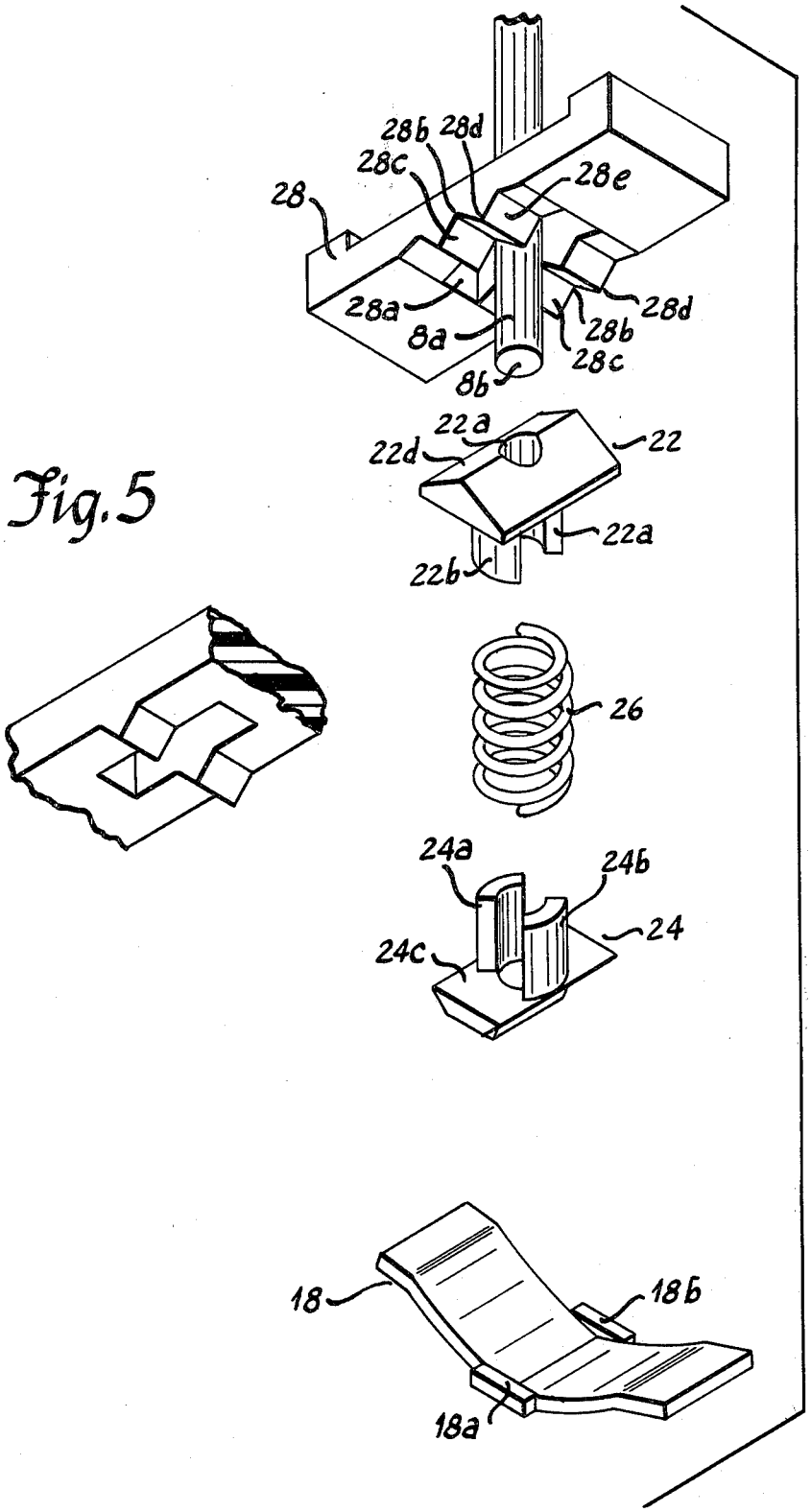
FIG. 4 is an enlarged exploded isometric view of the toggle lever shaft, indexing detent block, upper plunger, compression spring, lower plunger, and teeter-totter contactor of FIGS. 1-3.
FIG. 5 is an isolated isometric view of an alternate indexing detent block for use in a two position switch.

Molded in the bottom of the base are stationary contact terminals 12, 14 and 16, which have lower externally extending portions for circuit connection. A teeter-totter contactor 18 rocks on a support member 20 which is riveted to center common terminal 14. The support member is similar to the upper section of the support member in said Brown Patent and has spaced front and rear upstanding U-shaped sides which receive projections **18*a* and 18*b*, FIG. 4, in the bight of the U to guide the teeter-totter contactor. Clockwise rocking of contactor 18 about support 20 completes a circuit between terminals 14 and 16. Counterclockwise rocking of the contactor completes a circuit between terminals 14 and 12**. FIG. 1 shows a center position wherein neither of said circuits is completed.

The toggle lever has a shaft portion **8*a* extending downwardly from the pivot point into the base. A pair of actuators or plungers 22 and 24 are disposed on the shaft for sliding movement along its longitudinal axis. Upper plunger 22 has an aperture 22*a*, FIG. 4, through which the shaft extends, and a pair of spaced arcuate legs 22*b* and 22*c* extending downwardly from the bottom thereof between which the shaft extends. Lower plunger 24 has a pair of upstanding spaced arcuate legs 24*a* and 24*b* between which the shaft extends. Legs 24*a* and 24*b* are offset 90° from the orientation of legs 22*b* and 22*c* about the longitudinal axis of the shaft in order to afford sliding interfit of the plungers, i.e. leg 24*a* is slidable into the arcuate gap between legs 22*b* and 22*c*, and leg 24*b* is slidable into the opposite gap between legs 22*b* and 22*c*, while leg 22*b* is slidable into the arcuate gap between legs 24*a* and 24*b*, and leg 22*c* is slidable into the opposite gap between legs 24*a* and 24*b***, thus forming a cylinder when interfitted.

Figure 2:
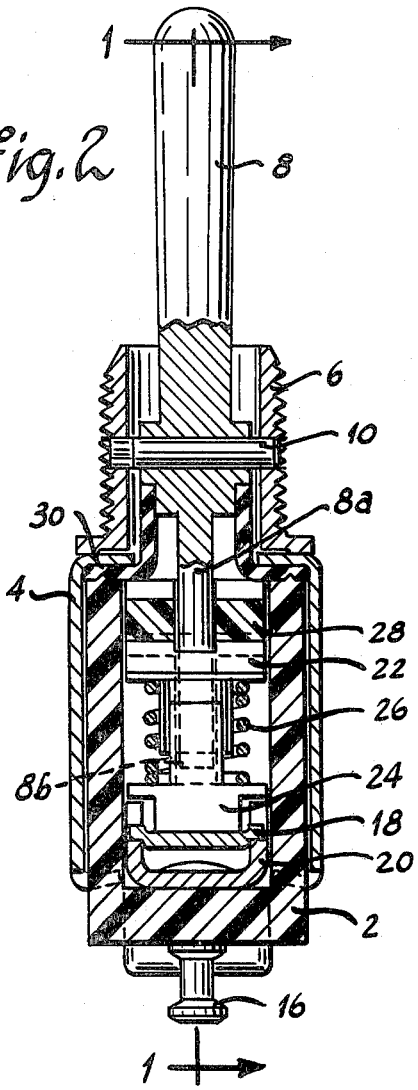
FIG. 2 is a cross-sectional view taken along line 2—2 of FIG. 1.
Figure 3:
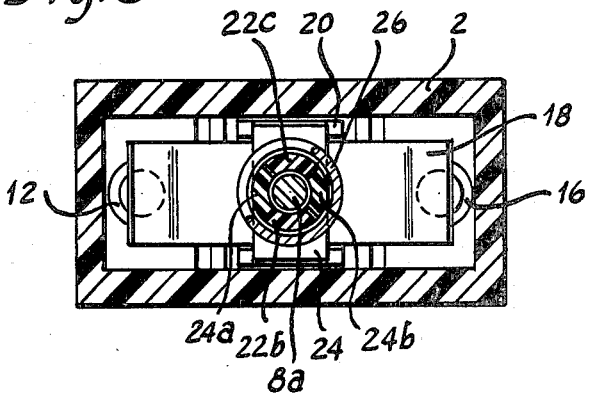
FIG. 3 is a cross-sectional view taken along line 3—3 of FIG. 1.

Concentrically surrounding the plunger legs and shaft is a helical compression spring 26 bearing between an undersurface of the upper plunger and a top surface **24*c* of the lower plunger to thus bias the plungers apart. Lower plunger 24 is biased into engagement with contactor 18, and upper plunger 22 is biased into engagement with an indexing detent block 28 which is stopped against a seal 30 which is stopped against cover 4. Thus, the upwardly biased movement of upper plunger 22 is stopped by block 28 whereby lower plunger 24 is biased downwardly against contactor 18. The bottom 8*b* of the shaft does not normally engage top surface 24*c*** of the lower plunger, as shown in FIGS. 1 and 2.

Seal 30 is a flexible rubber member pinched between base 2 and cover 4 at its outer periphery and molded to the toggle lever just below the pivot point to prevent environmental contamination of the switch interior.

The indexing detent block 28 fits generally adjacently along the inner perimeter of base 2 and is held in place against seal 30 and cover 4 by the upward bias of plunger 22. The block has an aperture **28*a* through which shaft 8*a* extends, the aperture being laterally extended to allow clearance of the shaft during pivoting thereof. On the underside of the block, there are formed a series of V-shaped grooves and apexes aligned on either side of the aperture to form a detent configuration for indexing by receiving the apexed head 22*d*** of the upper plunger.

Operation of the switch will now be described. FIG. 1 shows a center off position with lower plunger 24 engaging the center of teeter-totter contactor 18 and upper plunger 22 engaging middle groove **28*b* to be indexed therein. Apexed head 22*d* and groove 28*b*** are complementally configured so as to provide singular and positive feeling positioning of the toggle lever.

Counterclockwise pivoting of the toggle lever causes lower plunger 24 to move right of center along curved contactor 18. During this movement, upper plunger 22 is cammed downwardly as apexed head **22*d* slides along camming surface 28*c* of the block, thus further compressing spring 26 and hence increasing contact pressure upon contact make when theright end of contactor 18 engages the contact of terminal 16. Maximum compression of spring 26 occurs just as the apex of head 22*d* reaches the downwardly protruding apex 28*d* of the block. After the apex of head 22*d* passes apex 28*d* of the block, the head 22*d* snaps into groove 28*e* of the block with a positive feedback feel in the toggle lever indicating the switch is in an on condition with contactor 18 rocked to a clockwise position completing a circuit between terminals 14 and 16**. Return operation to the center position is similar with contact pressure increased at contact break to ensure non-teasing thereof, and a positive indexed feel upon reaching the center position. Clockwise pivoting of the toggle lever is comparable for the other on position of the switch.

It is thus seen that a single biasing means affords both contact pressure and indexing by biasing lower plunger 24 downwardly into engagement with the teeter-totter contactor and biasing upper plunger 22 upwardly into engagement with the indexing detent block. The contactor 18 may be made of uniform curvature on its upper surface between its two ends to provide a track for plunger 24 of constant radius about the pivot 10 of the toggle lever, whereby to minimize any effect the contactor contour may have on position feel of the toggle lever.

The positive position for each location of the toggle lever can of course be varied as needed by changing the shapes of the indexing block camming surfaces or grooves and/or upper plunger head. Apexes are preferred because this reduces the possibility of hang-up between positions. The number of positions can also be varied; for example, a two position switch would have only two camming surfaces and a single apex on the indexing detent block, FIG. 5, instead of the four camming surfaces shown for the three position switch.

It is recognized that various modifications are possible within the scope of the appended claims.

What is claimed is:

1. An electric switch comprising:

a housing;

contact means mounted in said housing;

operator means movably mounted to said housing;

first and second actuator means carried by said operator means, said first actuator means being engageable with said contact means for actuation thereof in response to movement of said operator means;

indexing detent means disposed in said housing and engageable with said second actuator means in indexing relation; and means biasing said first and second actuator means apart such that said first actuator means is biased into engagement with said contact means and said second actuator means is biased into engagement with said indexing detent means whereby a positive position feel of said operator means is provided by said indexing detent means corresponding to a condition of said contact means;

wherein said operator means has a shaft extending down into said housing, said first actuator means comprises a lower plunger disposed on said shaft at the bottom thereof for sliding movement along the longitudinal axis of said shaft, said second actuator means comprises an upper plunger disposed on said shaft above said lower plunger for sliding movement along said longitudinal axis of said shaft, and said biasing means bears between said upper and lower plungers to bias said lower plunger downwardly into engagement with said contact means and to bias said upper plunger upwardly into engagement with said indexing detent means;

wherein said indexing detent means comprises a stationary detent member disposed in said housing above said upper plunger, the undersurface of said detent member engaging the top surface of said upper plunger in detenting relation, and wherein said operator means is movable between at least two positions, a first position corresponding to an off condition of said contact means and a second position corresponding to an on condition of said contact means, and wherein said detent member has at least two detent portions formed on said undersurface thereof, a first detent portion engaging said top surface of said upper plunger in stable indexed detented relation when said operator means is in said first position and a second detent portion engaging said top surface of said upper plunger in stable indexed detented relation when said operator means is in said second position.

2. The switch according to claim 1 wherein said operator means comprises a toggle lever pivotally mounted to said housing, and wherein said contact means comprises teeter-totter type contact means having a rockable teeter-totter contactor engaged by said lower plunger.

3. The switch according to claim 2 wherein said detent member has at least two downwardly converging camming surfaces on said undersurface thereof meeting at a downwardly pointing apex, and wherein said upper plunger has a pair of upwardly conveying camming surfaces on said top surface thereof meeting at an upwardly pointing apex, pivotal movement of said toggle lever from said first to said second position causing rocking of said teeter-totter contactor to said on condition, one of said camming surfaces of said detent member engaging one of said camming surfaces of said upper plunger to cause downward camming of said upper plunger along said shaft against the bias of said biasing means during said pivotal movement to increase contact pressure on make by increasing the downward bias on said lower plunger.

4. The switch according to claim 3 wherein engagement of said detent member apex with said upper plunger apex during said pivotal movement of said toggle lever is unstable whereby to reduce the possibility of hang-up between said toggle lever positions.

5. The switch according to claim 4 wherein return pivotal movement of said toggle lever from said second to said first position causes rocking of said teeter-totter contactor to said off condition, the other of said camming surfaces of said detent member engaging the other of said camming surfaces of said upper plunger to cause downward camming of said upper plunger along said shaft against the bias of said biasing means during said return pivotal movement to minimize contact teasing on break by increasing the downward bias on said lower plunger.

6. The switch according to claim 5 wherein said toggle lever is movable to a third position corresponding to another on condition of said contact means, said first position of said toggle lever being a center off position, counter-clockwise pivoting of said toggle lever from said first to said second position causing clockwise rocking of said teeter-totter contactor, clockwise pivoting of said toggle lever from said first position to said third position causing counterclockwise rocking of said teeter-totter contactor to said other on condition of said contact means, said detent member having another two downwardly converging camming surfaces on said undersurface thereof meeting at another downwardly pointing apex, one of said other camming surfaces of said detent member engaging said one camming surface of said upper plunger to cause downward camming of said upper plunger along said shaft against the bias of said biasing means during said clockwise pivoting of said toggle lever from said first to said third position to increase contact pressure on make by increasing the downward bias on said lower plunger, and wherein engagement of said other detent member apex with said upper plunger apex during pivotal movement of said toggle lever is unstable whereby to reduce the possibility of hang-up between said first and third positions of said toggle lever, and wherein counterclockwise pivoting of said toggle lever from said third position to said first position causes clockwise rocking of said teeter-totter contactor to said off condition of said contact means, the other of said other camming surfaces of said detent member engaging said other camming surface of said upper plunger to cause downward camming of said upper plunger along said shaft against the bias of said biasing means during said counterclockwise pivoting of said toggle lever from said third to said first position to minimize contact teasing on break by increasing the downward bias on said lower plunger.

7. The switch according to claim 2 wherein said teeter-totter contactor has an upper surface forming a track for and engaged by said lower plunger, said upper surface of said teeter-totter contactor being of uniform curvature of constant radius about the pivotal axis of said toggle lever whereby to minimize the affects of said upper surface of said teeter-totter contactor on the positioning of said toggle lever.

8. The switch according to claim 1 wherein said detent member has an aperture therein through which said shaft extends, said aperture being elongated to allow clearance of said shaft during movement of said operator means, said upper plunger engaging said detent member on both elongated sides of said aperture.

9. The switch according to claim 8 wherein said detent member having an outer periphery generally coextensive with the inner periphery of said housing and fitting snugly within said housing generally abutting side walls thereof whereby said detent member is substantially stationary with respect to said housing, said detent member being retained within said housing by the upward bias of said upper plunger biasing said detent member against the undersurface of an pper portion of said housing.

10. An electric switch comprising:

a housing;

contact means mounted in said housing;

operator means movably mounted to said housing;

first and second actuator means carried by said operator means, said first actuator means being engageable with said contact means for actuation thereof in response to movement of said operator means;

indexing detent means disposed in said housing and engageable with said second actuator means in indexing relation; and means biasing said first and second actuator means apart such that said first actuator means is biased into engagement with said contact means and said second actuator means is biased into engagement with said indexing detent means whereby a positive position feel of said operator means is provided by said indexing detent means corresponding to a condition of said contact means;

wherein said operator means has a shaft extending down into said housing, said first actuator means comprises a lower plunger disposed on said shaft at the bottom thereof for sliding movement along the longitudinal axis of said shaft, said second actuator means comprises an upper plunger disposed on said shaft above said lower plunger for sliding movement along said longitudinal axis of said shaft, and said biasing means bears between said upper and lower plungers to bias said lower plunger downwardly into engagement with said contact means and to bias said upper plunger upwardly into engagement with said indexing detent means;

wherein said plungers have interfitting means enabling partially overlapped sliding movement of said plungers along said longitudinal axis of said shaft.

11. The switch according to claim 10 wherein said upper plunger has an aperture therein through which said shaft extends whereby said upper plunger is guided along said shaft, said lower plunger being guided along said shaft by said interfitting means.

12. The switch according to claim 11 wherein said interfitting means comprises spaced leg portions of said upper plunger extending downwardly therefrom adjacent said shaft, and also comprises spaced leg portion of said lower plunger extending upwardly therefrom adjacent said shaft, said leg portions of said upper plunger being oriented to be received in the spaces between said leg portions of said lower plunger, said lower plunger being guided for sliding movement along the longitudinal axis of said shaft by the interfitting of said leg portions.

13. The switch according to claim 12 wherein said legs portions are arcuate about said longitudinal axis of said shaft and form a cylinder when interfittingly engaged.

14. The switch according to claim 13 wherein said upper plunger has an upper portion above said leg portions thereof and said lower plunger has a lower portion below said leg portions thereof, and wherein said biasing means comprises a compression spring concentrically surrounding said cylinder formed by said leg portions and bearing between said upper portion of said upper plunger and said lower portion of said lower plunger.

* * * * *